United States Patent [19]

Kirby

[11] Patent Number: 4,597,032

[45] Date of Patent: Jun. 24, 1986

[54] LIGHTING FITTING

[75] Inventor: Alan Kirby, Swanage, England

[73] Assignee: Whitecrof plc, Wilmslow, England

[21] Appl. No.: 643,191

[22] Filed: Aug. 22, 1984

[30] Foreign Application Priority Data

Mar. 2, 1984 [GB] United Kingdom ..... 8405570

[51] Int. Cl.[4] ..... F21S 1/02

[52] U.S. Cl. ..... 362/145; 362/267; 362/363; 362/374; 200/51.09; 339/75 R

[58] Field of Search ..... 362/145, 226, 267, 294, 362/362, 363, 374, 446, 448, 375; 339/22 B, 75 M, 75 P, 75 R, 88 R; 200/51.09, 51 R

[56] References Cited

U.S. PATENT DOCUMENTS

| | | | |
|---|---|---|---|
| 3,168,624 | 2/1965 | Healy | 200/51.09 |
| 3,432,629 | 3/1969 | Field et al. | 200/51.09 |
| 3,723,724 | 3/1973 | Appleton | 200/51.09 |
| 4,142,179 | 2/1979 | Lowndes | 362/363 |
| 4,298,919 | 11/1981 | Karasawa | 362/226 |
| 4,388,681 | 6/1983 | Meyer | 362/374 |

*Primary Examiner*—Craig R. Feinberg
*Assistant Examiner*—David A. Okonsky
*Attorney, Agent, or Firm*—Fiddler & Levine

[57] ABSTRACT

A lighting fitting for hazardous areas comprises a central hub. Each lateral face of the hub incorporates a connector into which a module containing control equipment for the fitting may be housed. A further connector is disposed in the underside of the hub to receive the lamp. The hub houses a microswitch, which may be flameproof, through which the power supply to the connector is controlled. Springs in the connectors, a locking plate and an actuator shaft combine to prevent operation of the microswitch unless and until a lamp and all modules are connected to their respective connectors. This construction aids manufacturing flexiblity and economy and enhances safety.

10 Claims, 4 Drawing Figures

LIGHTING FITTING

The present invention relates to a lighting fitting particularly but not exclusively for use in an explosive or other hazardous atmosphere.

Fittings for such purposes are already known, for example, from British Patent Specification Nos. 1,557,702 and 1,604,720. In the fittings of these specifications the lamp enclosures are pressurised and a pressure switch is employed to switch off the power supply to the lamp in the event that a leak develops in the enclosure. Whilst this arrangement is satisfactory, the addition of the pressurised enclosure and pressure switch leads to expense which may not be necessary in certain cases.

According to the present invention there is provided a lighting fitting comprising a hub defining a connector for the lamp of the fitting and one or more additional connectors for control equipment for the lamp switch means within the hub for completing the power supply circuit to the connectors and means associated with the switch means for preventing operation of the switch means until connection is made between at least one connector and its associated lamp or equipment.

In a preferred form of the invention, there are five connectors in the form of sockets, one of which is on the underside of the hub and the other four of which are disposed respectively on four lateral sides of the hub. The underside socket receives a lamp and the other sockets modules housing half chokes a capacitor and an ignitor. The means associated with the switch means, which is a microswitch, comprises an actuator shaft which may be turned from outside the hub. On turning the shaft locks in the modules and lamp to their respective sockets before operating the microswitch to complete the supply circuit. Springs across all sockets prevent rotation of the shaft until all sockets have received their respective modules and lamp.

Figure 1:
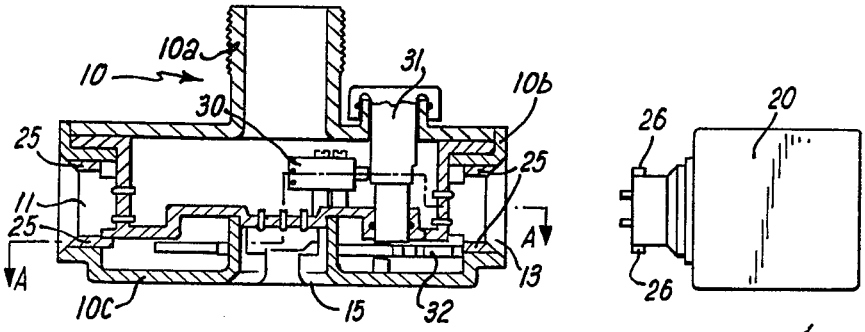
Figure 3:
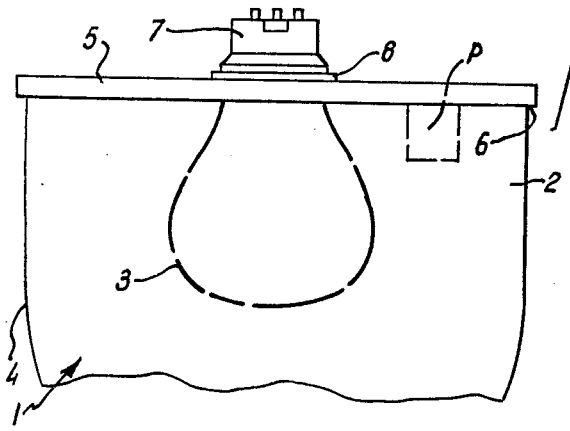
Figure 3:
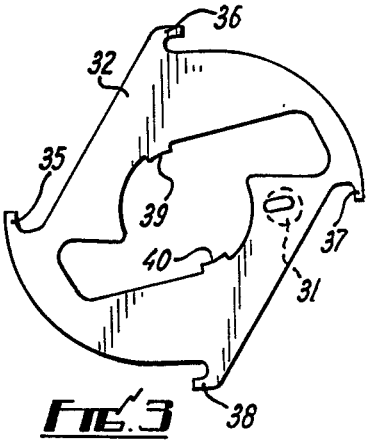
Figure 2:
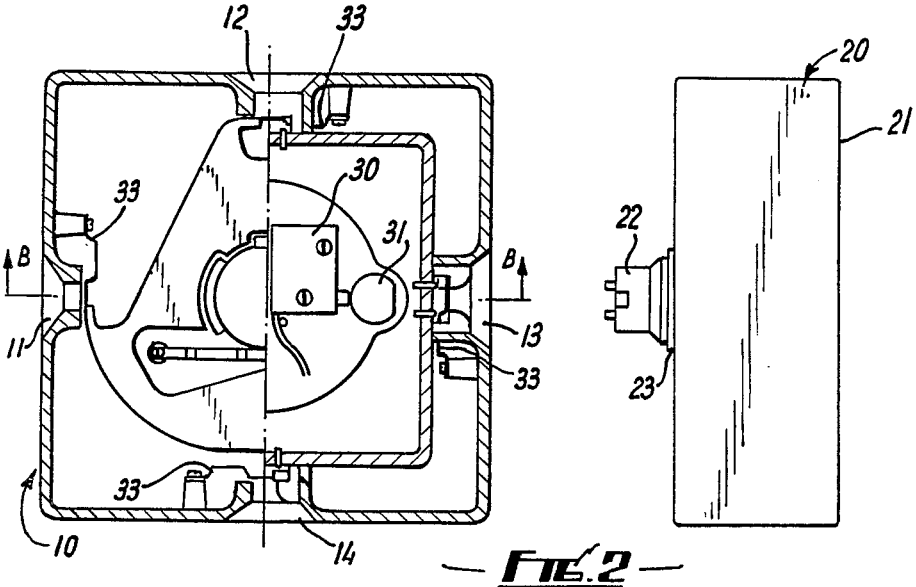
Figure 4:
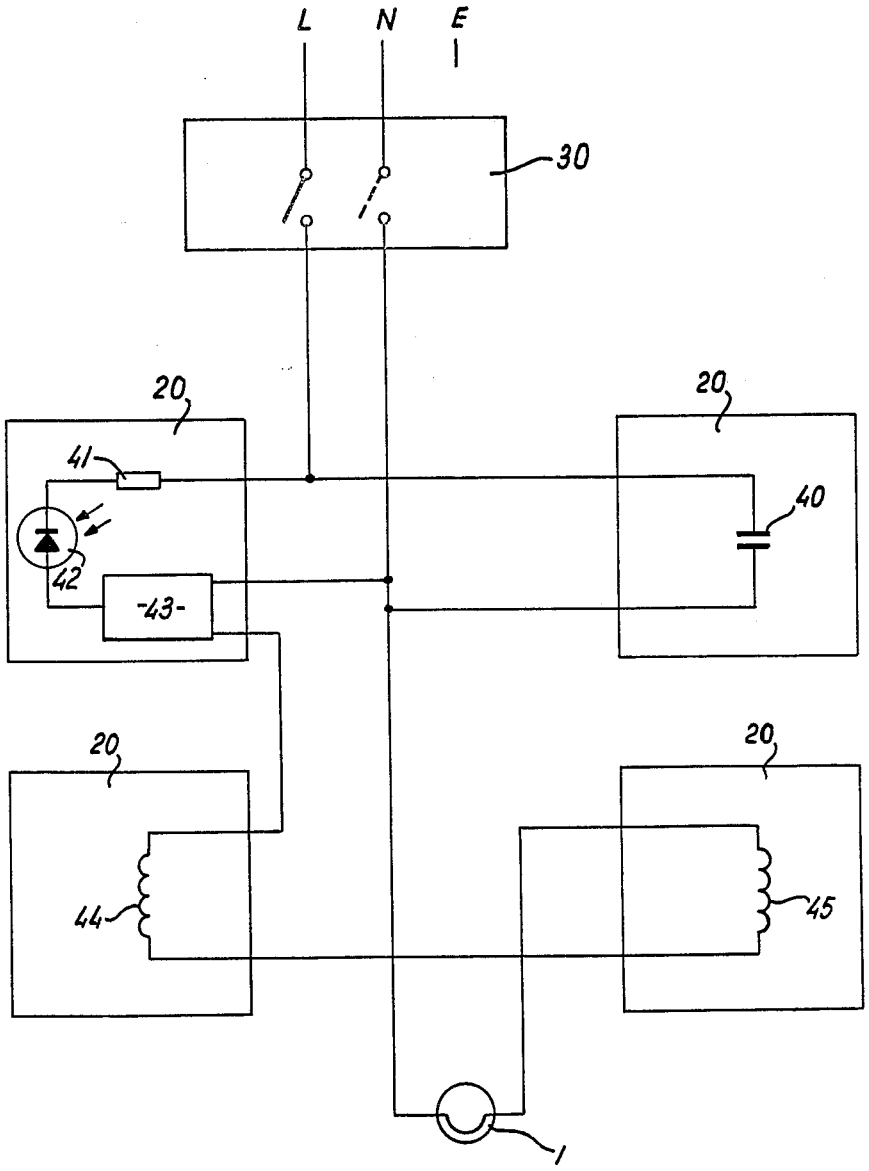

In order that the invention may be more clearly understood, one embodiment thereof will now be described, by way of example, with reference to the accompanying drawings, in which:

FIG. 1 is a side elevational view of a lighting fitting according to the invention along the line BB of FIG. 2, FIG. 2 is a plan view in section taken along the line AA of FIG. 1, FIG. 3 is a plan view of a part of the fitting of FIGS. 1 and 2, and FIG. 4 a typical circuit diagram for a fitting of the type shown in FIG. 1.

Referring to FIG. 1, the fitting comprises a lamp 1 having a housing 2 defining a safety enclosure in which a light source 3 is disposed. The housing consists of a "well glass" 4 and a top plate 5 welded to the "glass" along a line indicated at 6. Both the "well glass" 4 and the plate 5 are made of polycarbonate, the "well glass" being of a transparent or translucent grade. The use of polycarbonate facilitates manufacture, reduces expense and provides for better thermal shock characteristics than glass, although glass can also be used.

The plug 7 of the light source 3 extends out of the top plate 5. The length of this extension may be varied as required, in order to vary the distance between the "well glass" and the remainder of the fitting. This distance affects the amount of heat transmitted by the light source 3 to the remainder of the fitting during operation of the fitting, which is important for reasons referred to later. An 'O' ring seal 8 extends around the perihery of the extension. The lamp, as opposed to the light source within it, becomes a replaceable item when the light fails.

The remainder of the fitting comprises a substantially square section central hub 10 which defines five sockets. Four of these sockets respectively referenced 11 to 14 are disposed in respective lateral faces of the hub and the fifth referenced 15 is disposed in the underside of the hub to receive the plug 7 of the light source 3. Each socket has an array of five electrical contacts which are complementary to the similar array of five electrical contacts on the plug 7 and upon other modules to be inserted into the sockets. One of these modules referenced 20 is shown by way of example adjacent socket 13. Each module comprises a housing 21, also preferably moulded from a suitable synthetic plastics material, through one face of which a plug 22 extends complementary to the corresponding socket. An 'O' ring seal 23 extends around the plug 21. The housing 21 houses a part of the circuitry for the fitting. This may, for example, be a choke, a capacitor, an ignitor, a fuse, a photocell, a relay or an auxiliary power pack. Because the choke usually has a considerable weight and bulk, it would be advantageous to divide it into two half chokes and to place these half chokes in respective modules disposed on opposite sides respectively of the hub. In this way the volume and weight can be balanced about the central vertical axis of the fitting. If desired circuit parts within the modules may be potted to enhance their flameproof characteristics.

The hub is constructed from three mouldings **10*a*, 10*b* and 10*c* of synthetic plastics material such as glass reinforced plastics (GRP). One of these mouldings 10*b* has the electrical contacts of all of the sockets 11 to 15 moulded in. Each socket 11 to 15 is formed with slots 25 dimensioned to receive complementary projections 26 on the plug 22** of the corresponding module. In this way the correct relative position of each plug and socket on insertion of the plug can be ensured and by relative rotation of plug in socket after insertion, the plug can be retained in the corresponding socket.

Power supply to the five sockets 11 to 15 is controlled through a microswitch 30 disposed within the housing. This microswitch is actuated by an actuator shaft 31. The actuator shaft is shown extending out of the top of the hub 10, but may advantageously extend from the undersurface of the hub 10. The microswitch may be flameproof. The actuator shaft is interdependantly arranged with a locking plate 32 which is disposed in the hub 10 in a plane containing the lower parts of the sockets 11 to 14. Each socket 11 to 15 has a spring 33 associated with it and each of these springs 33 operates in a first position to prevent rotation of the locking plate 32 and in a second, displaced, position to permit rotation of the plate. Each spring 33 may be moved from its first to its second, displaced, position by insertion of the corresponding module or lamp. Not until a module or lamp has been inserted into each socket 11 to 15, therefore can the actuator shaft 31 be rotated. On rotation, each of four projections 35 to 38 on the external periphery of the plate 32 lodge behind the projections 26 on the corresponding plug to lock that plug into the hub 10. The projections 39 and 40 on the internal periphery of the locking plate 32 lodge behind the projections (not shown) on the plug of the lamp 1 to lock the lamp 1 in position in the hub 10. After locking has been effected the microswitch 30 is actuated to switch the power supply through to the contacts in the sockets 11 to 15 during the latter part of the rotational travel of the locking plate 32. Thus power can not be supplied to the lamp until every socket has received its module or lamp and no module or lamp can be removed from its socket without first switching off the power to the lamp.

The periphery of each socket is shaped in complementary fashion to the periphery of each plug thus improving the fitting's flameproof qualities. Although the inlet duct for the cable carrying the power supply is shown vertical provision may also be made to bring the cable in from either side or indeed to provide for a straight through side to side passage of a cable.

A typical circuit diagram from the above described fitting is shown in FIG. 4. The lamp 1 is supplied from the main supply via the microswitch 30. One module 20 houses a power factor correcting capacitor 40, one a fuse 41 photocell 42 and ignitor 43 and the other two two half chokes 44 and 45. The photocell enables the lamp to be automatically switched on when the ambient light falls.

It will be appreciated that the above embodiment has been described by way of example only and that many variations are possible without departing from the scope of the invention. For example, the number and position of the contacts in each socket, as also the number of sockets, may be varied as desired, the remainder of the fitting being redesigned as necessary. Although the fitting has been described in a vertical disposition, its orientation may be changed. Its main axis may, for example, be horizontally disposed. The disposition of the various modules, particularly in these other orientations may also be varied. With such alternative module disposition it may not be necessary, or even advantageous to provide half chokes. The auxiliary power pack may take any suitable form, but a battery having a reasonable shelf life would be preferred. The light source may be of any suitable form. It may be incandescent (for example tungsten filament), fluorescent or high intensity discharge. The fluorescent source may be low pressure mercury and the high intensity discharge source may be high pressure sodium, high pressure mercury low pressure sodium (sox) or halogen.

It will also be appreciated that maintenance requirement relating to replacing of circuit elements may be effected without the use of tools and, where as is usual the fitting is no more than two meters from the ground or platform, by an operative standing on that ground or platform. Also, the same basic hub structure may be used to standardise components and therefore reduce expense as the same hub may be used to supply many different customers requirements by appropriate choice of the modules and lamp. The distance between the "well glass" and the remainder of the fitting is important because this distance affects the amount of heat transmitted to the modules from the light source and therefore the temperature of the control gear within these modules. This in turn affects the acceptability of the fitting for use in hazardous areas in certain classes.

If desired, the lamp enclosure could be above or below ambient pressure and a pressure switch could be included to sense any change in pressure and to terminate the supply to the lamp if and when that occurred in similar manner to the arrangement described in British Patent Specification No. 1,557,702. A possible position for the pressure switch is indicated in dotted outline at P in FIG. 1 of the drawing.

What I claim is:

1. A lighting fitting having a lamp adapted for coupling to a power supply circuit said fitting comprising: a hub defining a connector for the lamp of the fitting and at least one additional connector for control equipment for the lamp; switch means within the hub for completing the power supply circuit to the connectors: an actuator for operating the switch means; and means associated with the switch means for preventing operation of the switch means until connection is made between every connector and its associated lamp, the means for preventing operation of the switch means comprising a locking member and elements associated with respective connectors, the elements being operative to prevent operation of the locking member and through it operation of the actuator, until connection is made between every connector and its associated lamp or equipment.

2. A lighting fitting as claimed in claim 1, in which each connector comprises a socket adapted to receive a complementary plug of the lamp.

3. A lighting fitting as claimed in claim 1, in which the elements are springs each having a first operative position preventing operation of the locking member and a second, displaced, and inoperative position permitting operation of the locking member.

4. A lighting fitting as claimed in claim 1, in which the locking member operates to lock the lamp into its connector.

5. A lighting fitting as claimed in claim 4, in which the locking member has an external periphery which defines projections which, in operation, cooperate with complementary formations on the equipment to lock it to its respective connector and an interal periphery which defines projections which, in operation cooperate with complementary formations on the lamp to lock it into its connector.

6. A lighting fitting as claimed in claim 1, in which each connector is formed in complementary fashion to a corresponding plug to improve the flameproof qualities of the fitting.

7. A lighting fitting as claimed in claim 1, in which the hub has a plurality of sides and a plurality of additional connectors is provided for respective sides.

8. A lighting fitting as claimed in claim 1, in which the means for preventing operation of the switch means operate to prevent such operation until all connectors are connected to their associated lamp.

9. A lighting fitting as claimed in claim 1, in which the switch means is a microswitch.

10. A lighting fitting as claimed in claim 9, in which the microswitch is flameproof.

* * * * *